United States Patent [19]

Powel et al.

[11] Patent Number: 4,901,941

[45] Date of Patent: Feb. 20, 1990

[54] REUSABLE WINDING TUBE

[75] Inventors: Stephen S. Powel, 4305 Tallwood Dr., Greensboro, N.C. 27410; Robert J. Darby, 2517-A Patriot Way, Greensboro, N.C. 27408

[73] Assignees: Stephen S. Powel; Robert J. Darby, both of Greensboro, N.C.

[21] Appl. No.: 321,162

[22] Filed: Mar. 6, 1989

[51] Int. Cl.[4] ..... B65H 75/28

[52] U.S. Cl. ..... 242/125.1; 242/118.32; 242/165

[58] Field of Search ..... 242/125.1, 125, 125.2, 242/125.3, 118.3, 118.31, 118.32, 18 PW, 159, 164, 165, 167, 176, 177, 178, 118.6, 118.62, 166

[56] References Cited

U.S. PATENT DOCUMENTS

| | | | |
|---|---|---|---|
| 1,991,880 | 2/1935 | Chaffin | 242/125.1 X |
| 2,837,297 | 6/1958 | Moss | 242/118.62 |
| 3,103,305 | 9/1963 | Heatherly | 242/125.1 X |
| 3,284,023 | 11/1966 | Sowell | 242/125.1 |
| 3,326,494 | 6/1967 | Hartley, Jr. | 242/125.1 |
| 3,625,451 | 12/1971 | Anderson | 242/125.1 |
| 3,717,291 | 2/1973 | Adams et al. | 242/125.1 X |
| 3,794,260 | 2/1974 | Sowell | 242/125.1 |
| 3,971,526 | 7/1976 | Underwood | 242/118.6 |
| 4,518,133 | 5/1985 | Hill, Jr. | 242/125.1 X |

FOREIGN PATENT DOCUMENTS

| | | | |
|---|---|---|---|
| 2463088 | 3/1981 | France | 242/125.1 |

*Primary Examiner*—Stanley N. Gilreath

*Attorney, Agent, or Firm*—Rhodes, Coats & Bennett

[57] ABSTRACT

An end cap is releasably mounted on the end of a cylindrical hollow tube to form a reusable cylindrical yarn carrier or winding tube which carries a filamentary or fibrous yarn thereon. A ring is slidably retained on the end cap in non-rotatably relation thereto between the adjacent end of the hollow tube and the confronting wall of the end cap. The confronting walls of the ring and end cap define a starting groove therebetween. A cavity of recess is formed, partially in the surface of each of the cap and ring, extending beneath and across the starting groove. When the yarn carrier has been emptied, the operator uses the cavity as access for scissors or a knife to sever the transfer tail and the major portion of the waste bunch. Later at a cleaning and refurbishing operation, the end cap is loosened from the hollow tube, and end cap and ring separated, and the remaining or residual fibers or filaments vacuumed or stripped away.

9 Claims, 2 Drawing Sheets

FIG. 3
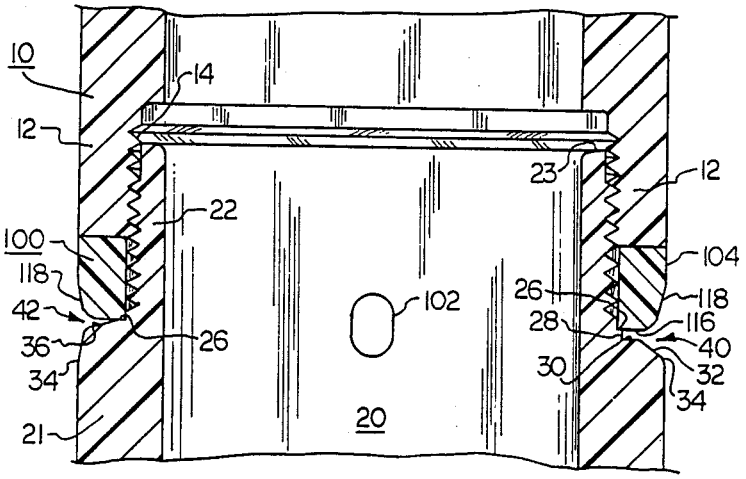
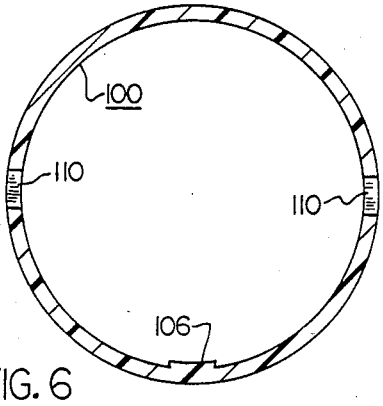
FIG. 6
FIG. 5
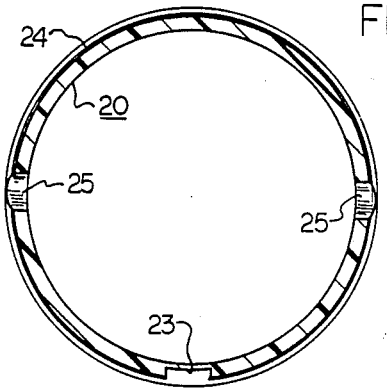
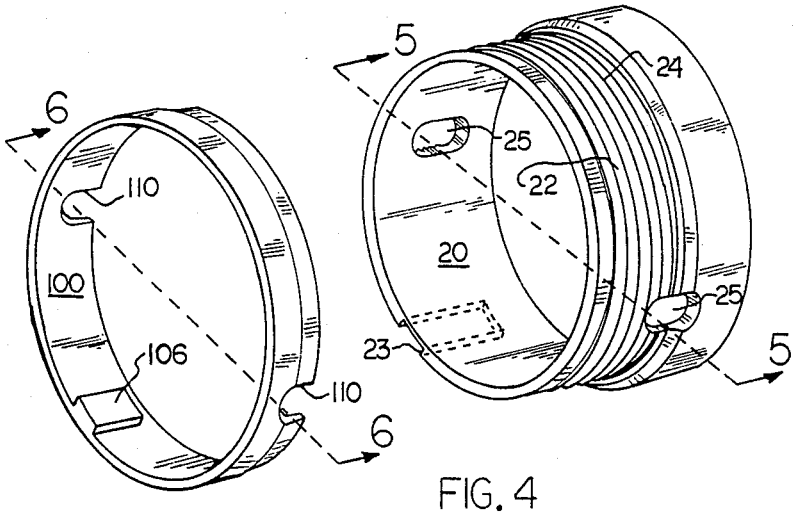
FIG. 4

REUSABLE WINDING TUBE

BACKGROUND AND SUMMARY OF THE PRESENT INVENTION

The present invention is directed to winding tubes primarily used in initially collecting and winding the newly spun synthetic yarn as it exits a spinneret. More particularly the invention is directed to a reusable winding tube in which the transfer tail is more easily severed and the remaining fibers or filaments are more easily removed from the starting groove which carries the waste bunch once the package has been emptied.

In conventional automatic winding operations, yarn is wound onto a cylindrical laminated paper tube (hereinafter referred to as a "paper tube"). One end of the paper tube includes a starting groove cut into the surface thereof (U.S. Pat. No. 3,103,305). The starting groove is sometimes, but not always, divided into two arcuate portions. The greater arcuate portion (approximately 270°) is wider and referred to as the lead-in portion, while the smaller (approximately 90°) arcuate portion (locking portion) is narrower and locks one or more of the initial strands of yarn therein during the initial few turns of the automatic winding operation. Alternatively, when processing fine denier yarns, the starting groove may be a constant cross-section throughout.

The starting groove generally extends completely around the periphery of the yarn carrier, as will be described hereinafter. It is possible, however, that the starting groove extends only partially around the yarn carrier as long as the arcuate length is sufficient to achieve a reliable latch-up. Therefore, while the ensuing description may be directed to a peripheral starting groove, it should be kept in mind that starting grooves which extend partially around the tube are also envisioned.

The initial strands are emplaced in the starting groove hereinafter and commonly referred to as the "waste bunch." The completed yarn package is removed from the winding machine, and stored or shipped for further processing. During further processing, the yarn is then removed from the yarn carrier for further processing such as weaving, knitting, or texturing.

When the yarn package is positioned on some type of creel for such further processing, the transfer tail is conventionally severed and tied to the front end of the successive yarn package. After the yarn is removed from the package, the last few strands of the waste bunch remain wedged in the lead-in and locking portions of the starting groove. Because of the construction of conventional paper tubes, it is very difficult to either snip or sever the transfer tail and waste bunch and/or to remove the remaining strands of fibrous or filamentary material. Previous attempts to remove the remaining strands have included vacuum stripping, cutting of the strands, or a combination of both. Neither technique is satisfactory, because vacuum stripping simply does not remove all the fibrous or filamentary material. Using a knife to sever the bunch generally results in damage to the surface of the paper tube making it unsuitable for further use. Such damage occurs when the laminates of the paper tube are nicked, cut, or otherwise interrupted. Use of a damaged tube at high speeds then tends to result in delamination.

As a result, conventional paper winding tubes are generally not reusable. There have been some attempts to reuse the tubes at least once by providing a transfer groove at each end of the tube. However, often the paper tube is otherwise damaged during the automatic doffing and emplacement operations which substantially eliminates the reuse of the paper tubes. Conventional paper tubes are relatively expensive (25¢ to $1.00 apiece) and hundreds of thousands or even millions of tubes are used each year by typical yarn manufacturers. Thus the cost of non-reusable yarn carriers is extremely high and the search for a satisfactory reusable yarn tube has been underway for some time.

Merely the replacement of paper tubes with a stronger material such as a polymeric material or aluminum is not an obvious solution. First, the proper configuration of the transfer groove cannot be molded or machined satisfactorily in the wall of a polymeric or metallic tube. Secondly, merely a change of material does not either facilitate the snipping of the transfer tail or solve the problems created by the necessity to clean the starting bunch groove. It is still not easy to vacuum the fibers from the groove, and utilizing a knife will still damage the surface of the tube so that it cannot be reused. While the use of polymeric material or metallic material such as aluminum may be a first step toward a reusable tube, it has been found that some improved technique for cleaning of the transfer groove is necessary in order to achieve a reusable winding tube.

Examples in the prior art of separable yarn carriers are illustrated in Chaffin U.S. Pat. No. 1,991,880; Moss U.S. Pat. No. 2,837,297; and Underwood U.S. Pat. No. 3,971,526. However, none of these yarn carriers are for high speed automatic winding operations or solve the problems attendant to the removal of residual fibers and filaments from a transfer groove and none address the problem of snipping the transfer tail.

In each of our copending applications, Ser. No. 200,939 filed May 31, 1988 and Ser. No. 258,187 filed Oct. 14, 1988, the tube is formed in two separable parts, i.e. the main hollow tube portion and a removable end cap. A peripheral groove of some prescribed shape is formed between the confronting end walls of the end cap and hollow tube to receive the transfer bunch during the automatic winding operation. After the yarn package is emptied the end cap is removed or partially removed from the hollow tube portion, the fibers or filaments vacuumed or stripped away, and the end cap replaced. The yarn carrier is then ready for reuse. A French Pat. No. 2,463,088 to Viscosuisse, S.A. shows a somewhat related concept in which a paper tube has a friction fit (apparently plastic) slip-on ring releasably attached to the end thereof. The slip-on ring has resilient fingers that fit inside the paper tube and hold the two components in assembled relation.

While all of the separable yarn carriers identified hereinabove have desirable characteristics and suggest improvements that might lead to a solution of the groove cleaning problem, they do not address the problem of severing the transfer tail incurred by the operator when the yarn package is initially placed in a creel. There are also examples in the prior art of winding tubes which include a cavity or hole in the surface thereof which permits an operator to insert the tip of scissors or a knife to snip the transfer tail. See U.S. Pat. Nos. 3,326,494 and 4,518,133. However, these patents do not address the cleaning of the waste bunch from the groove.

While it may initially seem that the inclusion of a cavity in the surface of the aforesaid separable winding tube could be easily accomplished, such is not the case. First the recess should underlie the starting groove so that the waste bunch and transfer tail may be severed simultaneously which allows removal of the major portion of the waste bunch. If snipping of the transfer tail alone is the sole requirements, a cavity or recess in the winding tube surface of the embodiment shown in our copending applications, Ser. Nos. 200,939 and 258,187 might suffice. However, it is desirable to be able to sever the transfer tail and waste bunch simultaneously, as above described, and since the starting groove is formed at the interface of two separable components which are threadingly engaged, a portion of the cavity must be formed in each component. It is essentially impossible to threadingly join two components so that a point on one component is aligned exactly with a point on the second component, particularly when the two components are repeatedly separated and rejoined. In use and reuse of such yarn packages as these, it is necessary to maintain the portions of the cavity aligned so as not to interfere with the winding and unwinding operation.

In the broadest aspect of the present invention, a separate intermediate ring is mounted on the threaded portion of the end cap between the end cap and adjacent end wall of the winding tube. The ring is longitudinally movable, but rotationally fixed with respect to the end cap. A cavity is formed partially in the surface of the cap and partially in the surface of the ring. The cavity extends axially across the starting groove. The starting groove is formed between the confronting walls of the end cap and intermediate ring. The hollow tube, end cap, and ring include mating surface configurations which selectively effect a secure attachment of the end cap to the tube, yet allow for selective separation of the end cap, intermediate ring and hollow tube to remove trapped fibers.

In its more specific aspects the reusable winding carrier of the present invention includes a hollow tube having an outer, substantially cylindrical surface adapted to carry a filamentary or fibrous yarn thereon. The end cap includes an outer substantially cylindrical surface having generally the same diameter as the outer surface of the hollow tube. The intermediate ring includes a key which cooperates with a key slot in the surface of the threaded shaft of the end cap to prevent rotation of the ring. The ring is internally unthreaded and axially movable along the threaded shaft of the end cap. An axially elongated cavity or slot extends through the surface of the end cap. A notch is formed in the edge of the intermediate ring which edge forms one side of the starting groove. When assembled on the threaded shaft of the end cap, the key and slot arrangement maintain the notch in proper alignment with the axially elongated cavity when the cap, ring, and winding tube are assembled. It is possible that both ends of the hollow tube may include releasable end caps and rings of the type described to further increase the life expectancy of the winding tube.

A starting or latching groove encircling the yarn carrier is formed between the confronting walls of the intermediate ring and end cap. The starting groove is preferably formed with a relatively narrow locking portion extending around a portion preferably (approximately 90°) of the periphery of the tube and a relatively wider lead-in portion extending around the remaining portion of the periphery. The lead-in portion guides the first few turns of the transfer bunch into the locking groove. The wider and narrower portions of the starting groove are formed by molding recesses into or chamfering one or both abutting ends of the hollow tube and/or end cap during the fabrication of the components. It should be recognized, however, that starting grooves of different shapes can be formed between the end cap and ring in accordance with the present invention. For example, in the winding of fine denier yarns, the starting groove is often of a constant size and shape around the periphery.

It is therefore an object of the present invention to provide a reusable yarn carrier which is separable to facilitate the cleaning of the starting groove and which also includes a cavity extending across the starting groove to facilitate severing of the transfer tail.

It is another object of the present invention to provide a yarn carrier of the type described in which an end cap is releasably attached to the main body portion with an intermediate ring therebetween, which ring, when assembled, forms with the end cap a starting groove.

It is another object of the present invention to provide a yarn carrier of the type described in which a portion of the cavity is formed in the end cap and a portion in an adjacent portion of the intermediate ring.

Yet another object of the present invention is to provide a yarn carrier of the type described in which the intermediate ring is longitudinally slidable, but rotatably fixed with respect to the end cap.

Other objects and a fuller understanding of the invention will become apparent upon reading the following detailed description of a preferred embodiment along with the accompanying drawings in which:

FIG. 3 is an enlarged sectional view with parts broken away, taken diametrically through one end of the yarn carrier of FIG. 2;

FIG. 4 is a perspective view of the end cap and intermediate ring removed from the cylindrical portion of the winding tube and separated;

FIG. 5 is a sectional view of the end cap looking along lines 5—5 in FIG. 4; and FIG. 6 is a sectional view of the intermediate ring looking along lines 6—6 in FIG. 4.

DETAILED DESCRIPTION OF A PREFERRED EMBODIMENT

Figure 1:
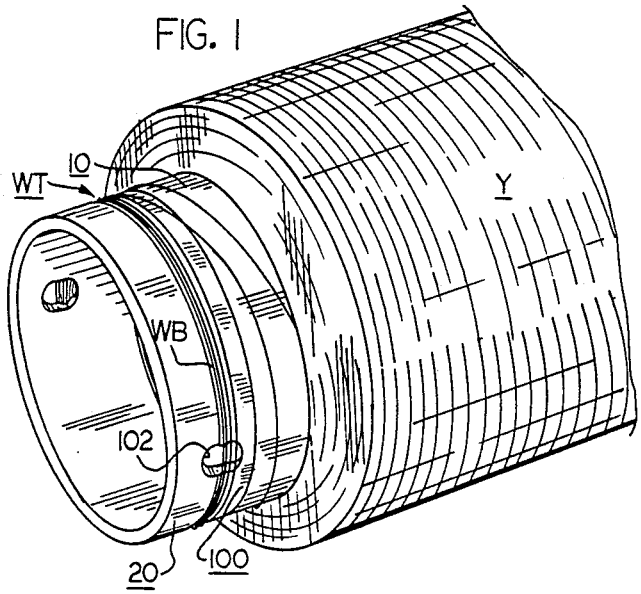
FIG. 1 is a perspective view illustrating a yarn package wound on a winding tube made in accordance with the present invention.

Turning now to the drawings, and particularly to FIG. 1, there is illustrated a yarn package of the type formed during the manufacture of yarn in accordance with conventional automatic winding techniques. The yarn package includes a winding tube WT about which thousands of turns of yarn Y are wrapped. The winding tube WT is formed of at least three parts, i.e. the cylindrical hollow tube 10, at least one end cap 20 and an intermediate ring 100. A starting groove extending around the periphery is formed between the intermediate ring 100 and releasable end cap 20. As the yarn package is initially formed, a relatively small number of turns of the yarn are guided into the starting groove where they are locked and form the waste bunch WB. The length of yarn extending between the waste bunch and the yarn package Y is referred to hereinafter as the transfer tail TT.

At the outset of the winding operation, an empty winding tube WT is initially emplaced on the spindle (not shown) of a winding machine ready to have yarn wound thereupon. At the outset of the automatic winding operation of polyester or any other extruded or spun synthetic yarn thereon, a vacuum hose is temporarily accepting the polyester or other polymeric yarn filament being extruded through a spinneret while awaiting the emplacement and start up of the winding tube. The vacuum hose is then held near the bottom periphery of the winding tube WT while a hand-held wire instrument is used by the operator to lift or move the yarn filament into engagement with the starting groove. As the yarn is guided into the starting groove, it latches up and breaks from the remainder of the yarn being carried away by the vacuum hose. After the break occurs, rotation of the winding tube causes a few turns to form a waste bunch in the peripheral groove 42. The waste bunch includes approximately one hundred or less turns. Formation of the waste bunch functions to lock the leading end of the yarn tail as well as to maintain the "off-spec" yarn out of the yarn package while the speed of the yarn being extruded and the rotation of the tube is stabilized. After the waste bunch is completed, the winder goes into a normal wind cycle with the yarn being wrapped around the main body of the hollow tube 10.

In use the yarn package is placed on a creel upstream of a loom, knitting machine, or texturing machine in a stationary position and yarn is pulled off the "take-off" end. The operator snips or severs the transfer tail through the waste bunch and ties the transfer tail to the lead end of the succeeding yarn package to be used. As illustrated in FIG. 1, a cavity 102 provides access for the operator to insert his knife or scissors through the waste bunch to perform the severing operation. Once the yarn package is emptied, the winding tube WT must either be discarded, or else the groove in which the waste bunch is wound must be cleaned of remaining fibers. While in conventional winding techniques, for all practical purposes the groove of a paper tube cannot be cleaned, in the present invention such cleaning is made possible and even facilitated.

Thus, in the present invention, once the winding tube WT is emptied, the end cap 20 and intermediate ring 100 are loosened from the hollow tube 10 and separated from each other (FIG. 2), whereupon the remaining fragments, filaments, or fibers of the waste bunch may be easily vacuumed or stripped away. The hollow tube 10 and end cap 20 are then tightened with the intermediate ring therebetween, and the yarn carrier WT is ready for reuse.

Figure 2:
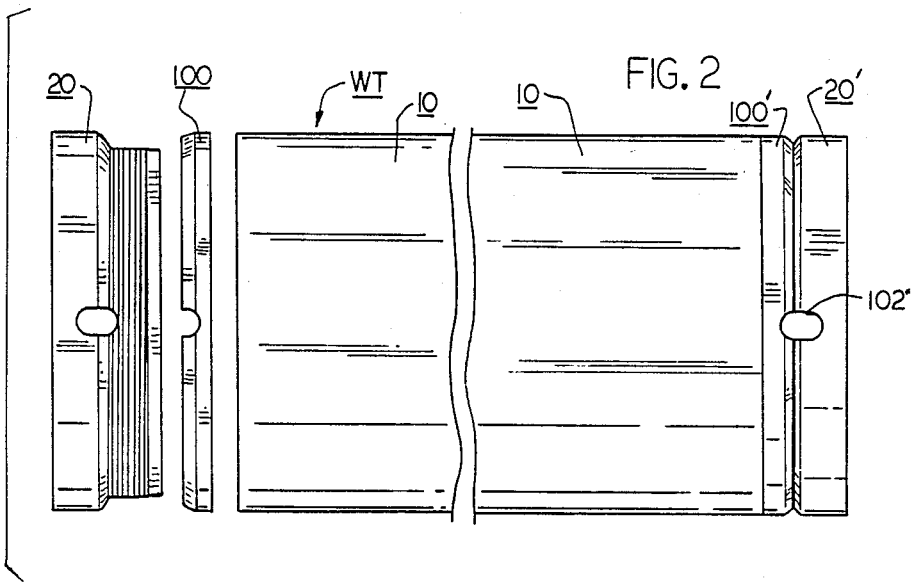
FIG. 2 is a side view, with parts broken away, illustrating the winding tube of the present invention.

Turning now to FIG. 2 there is illustrated an empty winding tube WT. Threads on the inside of the end portion of a hollow cylindrical tube 10 provide for the attachment of a releasable end cap 20 on at least one end thereof. The periphery of tube 10 and end cap 20 are substantially coextensive. An intermediate ring 100, also having a surface substantially coextensive with the tube 10 and end cap 20, is slidably attached to the end cap 20 in a non-rotatable relation. A cavity 102 is formed by portions in both cap 20 and ring 100. When the end cap 20 is tightened against the end of winding tube 10 with the intermediate ring therebetween the portions which form the cavity are brought into alignment. As illustrated in FIG. 2, a second end cap 20' and a second ring 100' may be releasably attached to the opposite end, in which case the life expectancy of the tube may be extended, and either end of the tube may serve to accumulate the waste bunch. However, it is felt that a quite satisfactory, long lasting winding tube WT can be fabricated which includes the end cap 20 on one end alone.

The materials from which the winding tube WT is formed may vary considerably. As described in copending application Ser. No. 200,939, both the hollow tube 10 and the end cap(s) 20, formed of a more permanent material such as polymers selected from the group containing polycarbonate, PBT, PVC, ABS, polytetraphthalate, glass filled polymers, and carbon filled polymers. The inserts may even be formed of aluminum, magnesium, or some other lightweight metallic material. As described in copending application Ser. No. 258,187, the cylindrical hollow tube may be formed of paper with polymeric or metallic inserts emplaced at one or both ends to receive the threaded polymeric or metallic end caps. The interface between at least the end cap 20 and the intermediate ring 100 should be formed of a rigid, incompressible material for reasons set forth in our copending U.S. application Ser. No. 321,638, filed Mar. 9, 1989. The ring 100 should be formed of a polymeric or metallic material. Further, as described in copending application 321,279 filed Mar. 9, 1989, the hollow tube might be formed of a thin walled, high tensile strength material with insert(s) to receive the threaded end caps.

Looking at FIG. 3, the relationship between the end cap 20, intermediate ring 100, and hollow tube 10 is best shown in the enlarged illustrations. The hollow tube 10 includes a marginal or terminal portion 12 having a reduced wall thickness and internal threads 14 extending peripherally around the interior wall thereof. The end of tube 10 bears against one wall of the intermediate ring 100 and maintains it in assembled relation to end cap 20. Ring 100 will be more fully described hereinafter, but includes an outer cylindrical wall 104 of the same diameter as that of tube 10 and end cap 20. A tapered or chamfered surface 118 joins the outer periphery 104 and the other end wall 116 of ring 100 to guide yarn being wrapped around hollow tube 10 in the area of the end portion thereof inwardly toward the peripheral groove portions 40,42.

The end cap 20 includes an outer cylindrical member 21 with an axially extending second portion 22 of reduced wall thickness and having outer threads 24 around the periphery thereof which mate with and engage the inner threads 14 of the marginal portion 12 of the hollow tube 10. The mating threads 14,24 form a means for releasably mounting the end cap 20 onto the hollow tube 10.

As best illustrated in FIGS. 4–6, ring 100 includes a key 106 extending axially on the inner surface. The key 106 is received in a mating key slot 27 on the threaded nose 22. Since the inner diameter of ring 100 is greater than the outer diameter of nose portion 22, the ring is slidable, but not rotatable. As the cap 20 is assembled onto the tube 10, the intermediate ring 100 is urged into engagement with the end cap 20. Immediately adjacent the base of threads 24 on end cap 20 is a radially extending peripheral rim 26 formed around the inner periphery of cylindrical member 21, which forms a stop means against which the end wall 116 of the ring 100 engages as the end cap is mounted on the hollow tube 10. The marginal or end portion 12 of hollow tube 10 is longer than the combined length of the ring 100 and nose 22 of the end cap 20, so that the end wall 116 will engage peripheral rim 26 prior to the time the terminal wall 23 of the end cap 20 would otherwise engage the corresponding portion of hollow tube 10.

A shoulder 28 extends around approximately three-fourths of the periphery of the end cap 20 (approximately 270°) and separates the peripheral rim 26 from a second or groove forming wall 30. The shoulder 28 maintains a separation (approximately 0.022 inches) between the end wall 116 of intermediate ring 100 and the second groove forming wall 30 which separation is substantially greater than the diameter of the yarn being wound thereon. The separation between end wall 16 and wall 30 forms the lead-in position 40 of the starting groove. A beveled surface 32 (approximately 45°) angles outwardly from the groove forming wall 30 toward the outer periphery of the end cap 20 to guide yarn into the groove between wall 30 and the end wall 116. Finally a slight chamfer 34 connects the outer periphery of end cap 20 with the first bevel chamfer 32.

In the remaining one-fourth (approximately 90°) of the periphery of the end cap, the shoulder 28 and groove forming wall 30 are replaced by the slightly angled peripheral rim 36 which, with end wall 116, forms the locking portion 42. Rim 36 does not extend radially, rather is tapered away from an imaginary radius by an angle of approximately 5° 30 min. Again the second rim 36 is connected to the outer periphery of end cap 20 by a chamfered surface 34.

Thus formed, there is a peripheral groove means formed between the confronting walls of the intermediate ring 100 and the end cap 20 which encircles the yarn carrier. The groove means includes first a relatively wide lead-in portion 40 which is formed by shoulder 28 and which extends approximately 270° around the periphery of the winding tube WT. Secondly a relatively narrow locking portion 42 is formed between the confronting end wall 116 of hollow tube 10 and the second peripheral rim 36 of end cap 26. So arranged, the yarns of the transfer bunch are directed toward the lead-in groove 40 and into the locking groove 42 as the winding tube is rotated.

It should here be pointed out that the illustrated embodiment is directed toward the type of winding tube WT that uses the particular starting groove configuration as illustrated in FIG. 3. While a large number of yarn packages utilize such types of winding tubes, the present invention is also directed toward winding tubes which have starting grooves of other configurations, such as, for example, a starting groove of constant cross-section around the entire periphery or throughout its arcuate length if less than the entire periphery.

A cavity 102 is formed in or through the walls of end cap 20 and intermediate ring 100 for the purposes described hereinabove. The cavity 102 may extend either entirely or only partially through the walls of the cap and ring. To avoid registry problems, and in accordance with the present invention, a portion 110 of the cavity is formed in ring 100 and a portion 25 of the cavity 102 is formed in the end cap 20. As illustrated in FIG. 4, one and preferably two axially elongated openings 25 spaced approximately 180° apart are provided in the wall of end cap 20. The axially elongated openings 25 are so positioned that at least a portion of the openings extend axially on either side of groove forming wall 30. Corresponding axially elongated slots 110 extend inwardly from the end wall 116 of ring 102. Slots 110 are also spaced apart approximately 180° and, when assembled, align with openings 25. The key 106 and key slot 27 are positioned substantially midway between slots 110 and 25 respectively.

To assemble the winding tube WT, the ring is placed on the threaded portion 22 of the end cap 20 with the key 106 engaged in key slot 27. The end cap is then assembled onto the winding tube 10 and tightened. As a result, each slot 110 registers properly with openings 25 to form the desired cavities 102. If desired, a single cavity 102 may be provided rather than two as illustrated. When the yarn package is assembled on the creel, it is then a simple matter for the operator to sever the transfer tail and the waste bunch using cavity 102 to provide access for his scissors or knife without damaging the surface.

As can be easily seen from FIGS. 3 and 4, when the yarn package is emptied, some yarn fibers and filaments tend to remain in the lead-in groove 40 and the locking groove 42. Such yarn ends cannot be vacuumed or stripped away in conventional, integrally formed paper tubes. However, the present construction permits the operator to loosen the end cap slightly, separate cap 20 and ring 100, whereupon the fibers and filaments are released and can be easily removed by suction or other stripping techniques.

As suggested earlier, the separable end cap and starting groove configuration may appear at both ends of the winding tube, if desired. While the invention has been described in detail hereinabove, it is obvious that various changes and modifications might be made without departing from the scope of the invention which is set forth in the accompanying claims, in which:

What is claimed is:

1. A reusable yarn carrier comprising:

(a) a hollow tube having an outer, substantially cylindrical surface adapted to carry a fibrous or filamentary yarn thereon;

(b) an end cap having an outer cylindrical surface substantially coextensive with the outer surface of said hollow tube, thread means for releasably mounting said end cap on at least one end of said hollow tube;

(c) an intermediate ring slidably retained on said end cap between said end cap and said one end of said tube, and locking means for preventing rotation of said ring with respect to said cap;

(d) confronting walls of said end cap and said ring defining a peripheral starting groove therebetween encircling said yarn carrier;

(e) a cavity formed by the combination of a recess in the surface of said cap and a recess in the surface of said ring, said cavity extending through the starting groove formed between said cap and said ring;

(f) whereby the cavity facilitates severing of the transfer tail and waste bunch, and said confronting walls of said intermediate ring and said end cap, when assembled form said starting groove, yet are separable to loosen remaining trapped fibers and facilitate cleaning for reuse.

2. The reusable yarn carrier according to claim 1 wherein said means for releasably mounting said end cap on at least one end of said hollow tube includes:

(a) a marginal end of said hollow tube having a reduced wall thickness and being provided with internal threads thereon;

(b) a cooperating marginal end portion of said end cap having a reduced wall thickness and being provided with exterior threads thereon; and (c) said interior threads and exterior threads mating together to permit assembly and disassembly of said end cap.

3. The reusable yarn carrier according to claim 2 wherein said locking means includes a key member extending axially along the inner surface of said intermediate ring and a key slot extending axially on the threaded marginal end portion of said end cap, said key and key slot mating together to provide for the slidable movement of said ring with respect to said end cap, but preventing rotation of said ring with respect to said end cap.

4. The reusable yarn carrier according to claim 2 wherein said recess in said cap includes at least one axially elongated opening extending through the wall of said end cap on either side of said peripheral starting groove and said recess in said ring includes at least one axially elongated slot extending inwardly from the end wall of said intermediate ring which confronts said starting groove, said axially elongated opening and said axially elongated slot being substantially aligned in the assembled position to provide access for an operator in snipping the waste bunch.

5. The reusable yarn carrier according to claim 1 wherein one of said end caps and intermediate rings is provided on each end of said hollow tube.

6. The yarn carrier according to claim 1 wherein said starting groove comprises a lead-in portion and a locking portion, said lead-in portion extending approximately 270° around the periphery of said tube and said locking portion extends approximately 90° around the periphery of said tube.

7. The yarn carrier according to claim 6, wherein said lead-in portion is formed by a shoulder separating the confronting walls of said ring and said end cap and said locking portion is formed by one of the abutting walls of said ring and said end cap being tapered from an imaginary radius.

8. The yarn carrier according to claim 7 wherein said lead-in portion has a width greater than the diameter of the yarns being wound thereon.

9. The reusable yarn carrier according to claim 1 wherein said end cap further includes a stop means for positioning said ring at a prescribed location with respect to said end cap, thereby insuring definition of said starting groove.

* * * * *